US011480302B2

(12) United States Patent
Fitzpatrick

(10) Patent No.: US 11,480,302 B2
(45) **Date of Patent: *Oct. 25, 2022**

(54) APPARATUS FOR GAS STORAGE AND TRANSPORT

(71) Applicant: GEV Technologies Pty. Ltd., West Perth (AU)

(72) Inventor: Patrick John Fitzpatrick, Calgary (CA)

(73) Assignee: GEV TECHNOLOGIES PTY. LTD., West Perth (AU)

( * ) Notice: Subject to any disclaimer, the term of this patent is extended or adjusted under 35 U.S.C. 154(b) by 222 days.

This patent is subject to a terminal disclaimer.

(21) Appl. No.: 16/325,027

(22) PCT Filed: Aug. 3, 2017

(86) PCT No.: PCT/CA2017/050928

§ 371 (c)(1),
(2) Date: Feb. 12, 2019

(87) PCT Pub. No.: WO2018/027308

PCT Pub. Date: Feb. 15, 2018

(65) Prior Publication Data

US 2020/0011481 A1 Jan. 9, 2020

Related U.S. Application Data

(60) Provisional application No. 62/374,488, filed on Aug. 12, 2016.

(51) Int. Cl.
*F17C 5/06* (2006.01)
*B63B 25/14* (2006.01)
(Continued)

(52) U.S. Cl.
CPC ..... *F17C 5/06* (2013.01); *B63B 25/14* (2013.01); *B63B 27/24* (2013.01); *B63B 35/28* (2013.01);
(Continued)

(58) Field of Classification Search
CPC .... F17C 5/06; F17C 1/002; F17C 2201/0138; F17C 2203/0639; F17C 2205/0146;
(Continued)

(56) References Cited

U.S. PATENT DOCUMENTS 2,810,265 A * 10/1957 Beckwith ..... F17C 3/025 62/48.3
3,830,180 A * 8/1974 Bolton ..... F17C 1/002 114/74 A
(Continued)

FOREIGN PATENT DOCUMENTS

CA 2283008 C * 9/2007 ..... B63B 25/28
EP 2179889 A1 * 4/2010 ..... B60P 3/055
EP 2179889 A1 4/2010

OTHER PUBLICATIONS

EP-2179889-A1_English_Translation_of_Specification.pdf (Year: 2020).*
(Continued)

*Primary Examiner* — Reinaldo Sanchez-Medina
*Assistant Examiner* — Stephanie A Shrieves
(74) *Attorney, Agent, or Firm* — James F. Lea, III; Gable Gotwals

(57) ABSTRACT

An assembly for storing and transporting compressed fluid, such as compressed natural gas (CNG) that includes; a plurality of hexagonally stacked pipe stored in a cargo hold in or on a vessel, such as a ship or barge, that includes a lower support, side supports and a forcing mechanism that presses so strongly down on the pipes that they cannot move
(Continued)

relative to themselves or relative to the vessel on which they are placed in any service situation. The friction between each of the pipes causes the plurality of pipes to act as part of the vessel in terms of its structure. Each of the pipes in the plurality of pipes is connected to a manifold system to allow or the loading and unloading of the compressed fluid.

10 Claims, 4 Drawing Sheets

(51) Int. Cl.
*B63B 27/24* (2006.01)
*B63B 35/28* (2006.01)
*F17C 1/00* (2006.01)

(52) U.S. Cl.
CPC ..... *F17C 1/002* (2013.01); *B63B 2231/04* (2013.01); *F17C 2201/0138* (2013.01); *F17C 2203/0639* (2013.01); *F17C 2205/0146* (2013.01); *F17C 2205/0352* (2013.01); *F17C 2221/033* (2013.01); *F17C 2223/0123* (2013.01); *F17C 2223/036* (2013.01); *F17C 2270/011* (2013.01); *F17C 2270/0105* (2013.01)

(58) Field of Classification Search
CPC ..... F17C 2205/0352; F17C 2221/033; F17C 2223/0123; F17C 2223/036; F17C 2270/0105; F17C 2270/011; F17C 1/00; B63B 25/14; B63B 27/24; B63B 35/28; B63B 2231/04
USPC ..... 137/259
See application file for complete search history.

(56) References Cited

U.S. PATENT DOCUMENTS

| | | | | |
|---|---|---|---|---|
| 3,863,460 | A * | 2/1975 | Straile | B63B 25/12 62/53.2 |
| 3,937,353 | A * | 2/1976 | Becker | B63B 25/16 220/560.12 |
| 5,040,933 | A * | 8/1991 | Lee | B60P 7/12 410/35 |
| 5,803,005 | A * | 9/1998 | Stenning | B63B 25/22 114/72 |
| 5,839,383 | A | 11/1998 | Stenning et al. | |
| 6,584,781 | B2 * | 7/2003 | Bishop | F17C 7/04 62/54.1 |
| 8,091,495 | B2 * | 1/2012 | Donnelly | B63B 5/14 114/74 A |
| 9,376,049 | B2 | 6/2016 | Campbell | |
| 9,975,609 | B2 * | 5/2018 | Fitzpatrick | F17C 1/002 |
| 10,752,324 | B2 * | 8/2020 | Fitzpatrick | F17C 1/002 |
| 2007/0014636 | A1 | 1/2007 | Breivik et al. | |
| 2009/0107853 | A1 * | 4/2009 | Tan | C01B 3/0015 206/0.7 |
| 2010/0050925 | A1 * | 3/2010 | Donnelly | B63B 25/14 114/74 R |

OTHER PUBLICATIONS

European Patent Office, European Search Report for European Patent Application No. 17838251.1, Feb. 26, 2020.

ISA/CA, International Search Report for PCT/CA2017/050928, dated Nov. 7, 2017.

* cited by examiner 19
12
10
13
6
11
4

12
14
10
14
6
15
16

10
4C
4C
6
12

APPARATUS FOR GAS STORAGE AND TRANSPORT

FIELD OF THE INVENTION

The invention relates to an apparatus and method for the marine storage and transport of gases, such as natural gas.

BACKGROUND OF THE INVENTION

There are known methods of transporting natural gas across bodies of water including for example, through subsea pipelines, by LNG ships as liquefied natural gas or by CNG ships as compressed natural gas (CNG). There are other known means such as converting the gas to gas hydrates or to a diesel-like liquid (GTL) and shipping the hydrates or GTL by ship. Currently, virtually all transport of natural gas across bodies of water is carried out by either subsea pipelines or LNG ships.

The transport of liquefied natural gas (LNG) on ships is a large, well established industry but the transport of compressed natural gas (CNG) by ships or barges is almost non-existent. One of the major impediments to shipping CNG by sea is the cost of a CNG containment system that is suited to ship or barge transport. Thus, there is an ongoing need to design storage systems for compressed gases, such as CNG, that can contain large quantities of CNG and that are particularly suited to installation on or within ships and barges in a way that reduces the overall cost of the CNG ship or barge.

The terrestrial transport of CNG by truck is well known. For decades CNG has been transported in tube-trailers. CNG is a common fuel for motor vehicles and a variety of CNG storage tanks are available for storing fuel in a motor vehicle. Also pipes of various dimensions are often transported by truck or in ships or on barges. It is well known in these industries that by strapping or holding down hexagonally stacked pipe with sufficient force enough friction can be generated to restrict pipes from slipping out of the stack under normal loads. Sometimes a frictional material is placed between the pipe layers to enhance the friction. However, none of these solutions have been able to provide a cost effective CNG ship or barge for the bulk transportation of large quantities of CNG.

One of the preferred methods of constructing a CNG containment system for a ship or barge is to stack pipes longitudinally approximately the full length of the barge or ship in a hexagonal, close spaced fashion. One such method is disclosed in Canadian patent number 2,283,008 filed Sep. 22, 1999. The CNG barge described in this patent had installed on its deck a gas storage assembly, which included a stack of horizontally oriented, long pipes stretching approximately the full length of the barge deck. The stacking was close spaced and one aspect of the invention was that the pipe could be stacked hexagonally together touching one another thus creating a friction bond.

While the barge and ship described in Canadian patent no. 2,283,008 is a possible way to transport CNG, the invention did not take into account the motions of a barge or ship as pitches, yaws, and heaves in response to waves, currents and winds. Nor did it take into account the deflection of the barge or ship itself as it bends, twists and otherwise deflects as it is subjected to the loads caused by the waves. Nor did it take into account the expansion and contraction of the pipes as they are exposed to pressure and temperature changes that will occur as the pipes are loaded and emptied of compressed gas. The flexing and accelerations caused by the sea conditions and the differential temperatures and pressures caused by loading and unloading the pipe will cause the pipes to slide and move relative to each other and relative to the barge or ship.

SUMMARY OF THE INVENTION

The invention relates particularly to the marine gas transportation of non-liquefied compressed natural gas although it could be used to transport other gases. It is an object of the present invention to reduce the cost of ships or barges designed to carry compressed gases, such as CNG.

A gas storage system particularly adapted for the transportation of large quantities of compressed gases, such as CNG, in or on a ship or a barge, primarily by means of long, straight hexagonally stacked lengths of pipe that are so strongly forced together that they cannot move relative to each other or to the ship and are connected by a manifold. Hereinafter the description will focus on a ship application to carry CNG below the top deck but it is obvious to one skilled in the art that this invention could also be employed on the top deck of the ship or on the top deck of a barge or below the top deck of a barge. It is also obvious to one skilled in the art that this invention could also be employed to carry compressed gases other than CNG.

The pipe runs the almost the entire length of the ship in continuous straight lengths and is hexagonally packed and firmly pressed together by a forcing mechanism. As described in Canadian patent number 2,283,008 the ship can be designed so that the holds of ship can be the entire length of the ship with the watertight transverse bulkheads being accommodated by filling the gaps between the hexagonally stacked pipes with a watertight material at the required intervals. The pipe diameter can be of any reasonable dimension, e.g., from approximately 8 inches to approximately 36 inches or other diameters. The precise diameter and length of pipe will depend on the economics of the system taking into account the cost of the various components making up the system, such as the cost of pipe materials, such as steel, and the connection manifold, at the time and location of construction.

This present invention is comprised of an assembly of long pipes, hexagonally stacked and touching one another with a forcing mechanism that forces the pipes so firmly together that it firstly prevents any relative movement of the pipe as the ship, containing this system, moves in an open ocean environment. Secondly, the present invention prevents any strains caused by the flexing or twisting of the ship itself to be transmitted to the assembly of long pipes. Thirdly, the present invention prevents any relative movement between the individual pipes in the assembly caused by differential temperature or pressure. It accomplishes these goals by forcing the pipes so strongly together that the resulting friction between the pipes prevents any pipe from moving relative to the other in any circumstance, including the flexing of the ship itself. This requirement goes far beyond any friction element that would normally be employed to prevent slippage of one pipe relative to any other pipe as a stack of pipes would be transported by a truck or ship. As a way to picture this, it is like all of the pipes are fastened together in their entirety and to the ship or barge hull by means of a weld. By locking the pipes together by the friction caused by the forcing mechanism, the overall stiffness of the vessel is increased so that flexing and twisting of the vessel is significantly reduced and so that the assembly of pipes and the vessel move in unison. Increasing the overall strength of a barge or ship by means of forcing a plurality pipe sufficiently together so they act as though they are welded together and welded to the ship is unprecedented and novel. The purpose of doing this is to maximize the amount of CNG stored in the plurality of pipe that is contained within the space available either on the deck or in the holds of a ship or barge and thus create a lower cost means of transporting CNG. The invention comprises:

i. a lower support and side supports fixed to each side of the lower support into which the plurality of pipes can be positioned. The side supports are approximately perpendicular to the lower support.

ii. a plurality of pipes for fluid containment, each pipe of the plurality of pipes having a means of connection to a manifold system, the plurality of pipes being stacked in a hexagonal manner on the lower support, between the side supports.

iii. a top fixed support that does not move relative to the side supports, although both the top fixed support, the fixed side supports and the bottom support deflect slightly and elastically as the force is applied.

iv. an upper forcing member beneath the top fixed support that is free to move up and down relative to the side supports and to forcefully bear down on the stack to apply compressive force to the plurality of pipes stacked in the hold that results in sufficient friction between the pipes to.

a. prevent any significant relative motion between the pipes themselves or between the pipes and the lower support, the side supports or the forcing member.

b. accommodate any relative motion of the barge or ship so that the hull of the barge or ship acts in concert with the plurality of pipes. In other words, the plurality of pipes adds to the strength of the barge or ship so that any motion induced by the environment on the ship or barge does not cause any relative motion between the hull and the plurality of pipes.

c. prevents any relative movement of the individual pipes caused by differential pressures and temperatures.

d. allows for adjustments of the force during the first pressure cycle to accommodate any shakedown that may occur.

v. The forcing mechanism has bracing to provide longitudinal restraint to the forcing mechanism to prevent any longitudinal movement of the forcing mechanism in any conditions, for example, collision, or movements caused by waves, gas pressure or other factors.

vi. a means of the generating the force on the forcing member.

vii. a means of spreading the concentrated stresses generated by the compressive force forcing the pipes against the bottom, top, and side supports, such as a layer of empty pipe surrounding the gas containing pipe.

viii. a means of connecting each of the of pipes to a manifold system for filling and unloading fluid, such as natural gas to the pipes.

The evaluation of the required confining stress is non-trivial and unique to this invention. The relationship between these factors is critical to assess the required confining force to resist all loads, in particular longitudinal forces resulting from any event such as waves, collisions etc. This relationship is described in the equation below;

N—is the number of gravitational accelerations to which the invention is subjected.

$C_f$—is the coefficient of friction between bare steel pipe (approximately 0.70)

P—is the confining pressure generated by the forcing mechanism described below

L—is the length of the pipe $d_1$—is the outside diameter of a single pipe

D—is the average of the height and width of the plurality of pipes $W_p$—is the weight of one pipe plus the weight of the fluid inside the pipe, such as compressed natural gas $$N=CfP\pi L(d1)2/DWp$$

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. In particular, the top support member could be designed to also be the forcing member. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example and not by way of limitation, wherein.

DETAILED DESCRIPTION OF THE PREFERRED EMBODIMENTS

Figure 1:
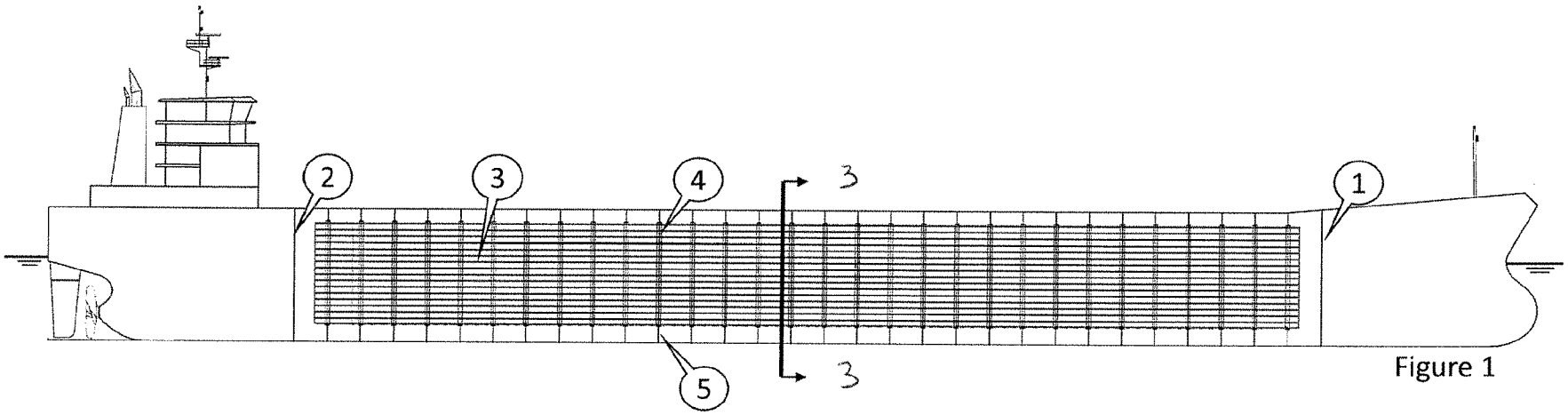
FIG. 1 is a side elevation of a ship according to the present invention.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A compressed gas transport assembly is disclosed. The assembly of the invention may be installed on or in a ship or barge for marine transport of compressed gas such as CNG. For the purpose of this detailed description of the embodiments a ship is shown with the assembly inside the ship's hull. This is intended as a means of describing the invention and is not a limitation. It is readily apparent to those skilled in the art that the assembly could be modified by to be placed on the deck of a ship or barge, or in the hull of a barge.

Figure 2:
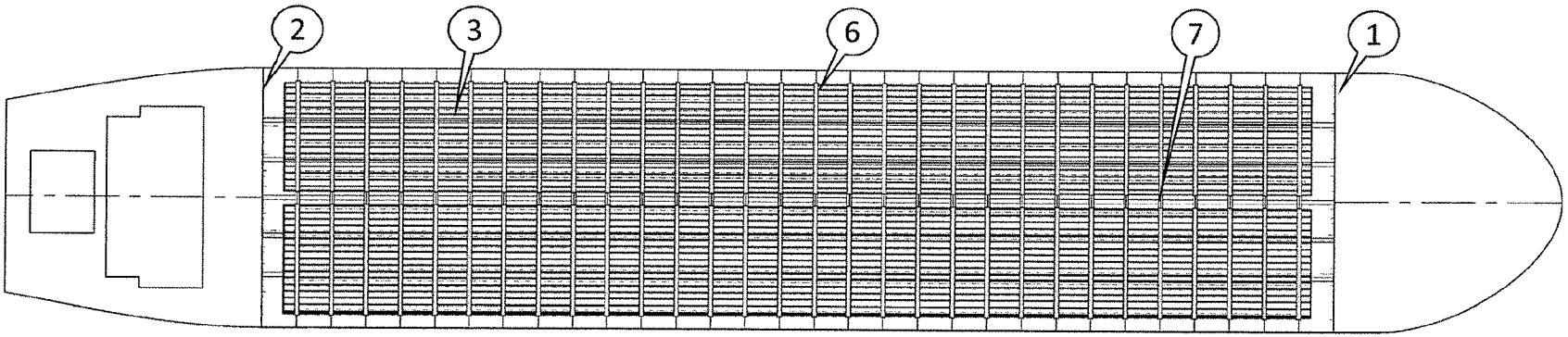
FIG. 2 is a plan view of ships according to the present invention

Referring to FIG. 1, shown is a side elevation of a transport vessel, such as a ship. Gas transport assembly is enclosed within the hull of the ship, contained between the forward cargo bulkhead 1 and aft cargo bulkhead 2. A centerline longitudinal bulkhead 7, shown in FIG. 2, divides the ship into two cargo holds, a starboard cargo hold and a port cargo hold. A plurality of pipes 3 is supported on bottom support members 5, which may be incorporated in the bottom of the ship's hull. Plurality of pipes 3 are located between a plurality of side support members 4, which may be part of the side hull of the ship and may be part of the centerline longitudinal bulkhead. In one embodiment, friction element 19 is placed between the pipes 3. Friction element 19 may be a roughening of a surface of pipes 3 or other preparation of the surface of pipe 3 to maximize friction between pipes 3. These support members are spaced along the length of the cargo hold, typically 9 equally spaced and aligned with each other as shown in FIGS. 1 and 2. This embodiment of the invention shows that the cargo hold is free from any transverse bulkheads so the pipes can stretch almost the entire length of the cargo hold. If water tight transverse bulkheads are required, then these can be provided by means disclosed in Canadian patent no. 2,283,008, such as placing a sealing material between the spaces formed by the hexagonally stacked pipes.

Referring to FIG. 2, is a plan view of the ship is shown. Top forcing members 6 are spaced so top forcing members 6 align with the side support members, but are not connected to them. Centerline bulkhead 7 separates the port and starboard cargo holds and may incorporate the interior side support members.

Figure 3:
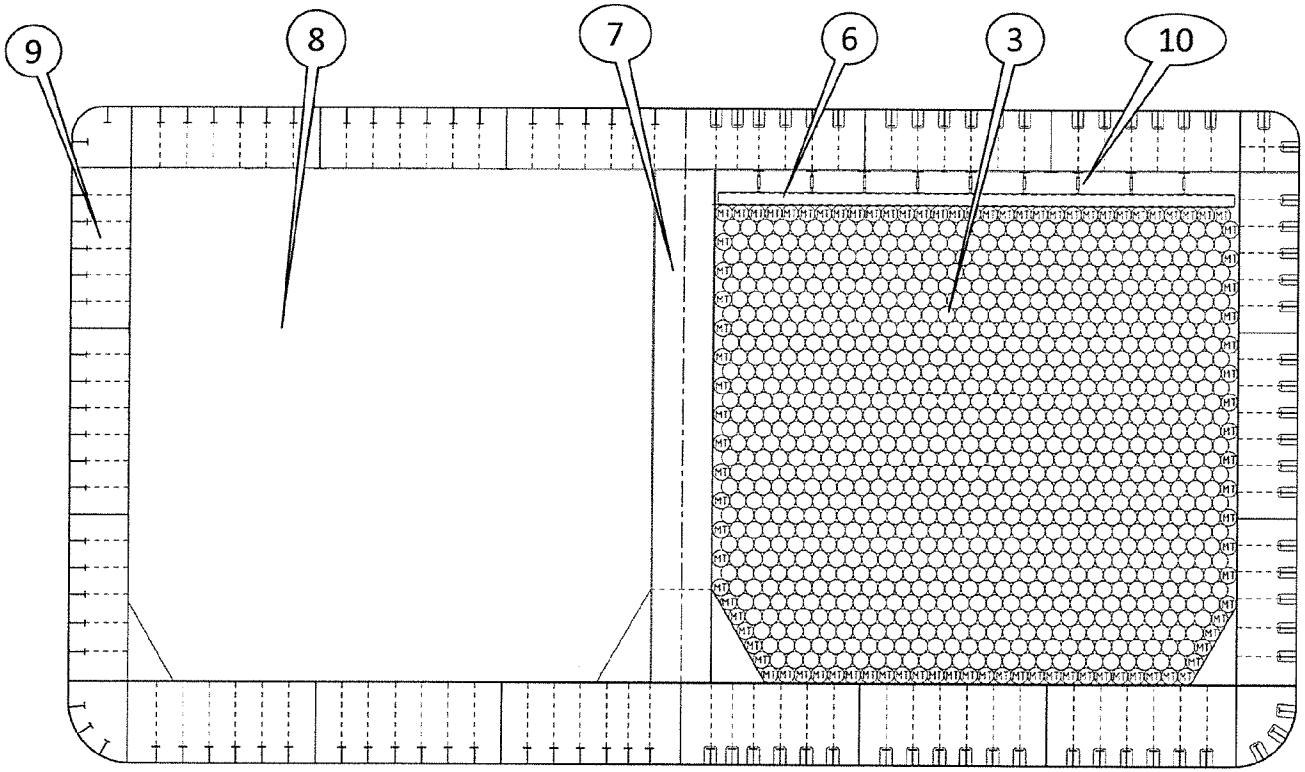
FIG. 3 is a section along 3-3 of FIG. 1, wherein a gas storage assembly according to the invention is more clearly shown.

Referring to FIG. 3, shown is a cross-section taken along line 3-3 of FIG. 1. For illustrative purposes, FIG. 3 shows port cargo hold 8 without the plurality of pipes and shows the starboard cargo hold with the plurality of pipes 3 located therein. In practice, both the port and starboard cargo holds would be filled with pipe. The hull of the ship 9 surrounds the port and starboard cargo holds. In one embodiment, hull 9 incorporates the outside vertical support members, the top support members and the bottom support members. Longitudinal bulkhead 7 is part of the ship structure and also incorporates the inner side support members.

The forcing member 6 is shown with the forcing mechanism being a plurality of jacks 10 between a forcing beam and the fixed top support member, which is part of the top deck of the ship. Other means of generating the force required are contemplated. However, the force must be substantial enough to prevent movement of the pipes as described previously. In the embodiment of the invention described here the approximate range of force per jack is between 25 tonne and 125 tonne.

Figures 4A, 4B, 4C:
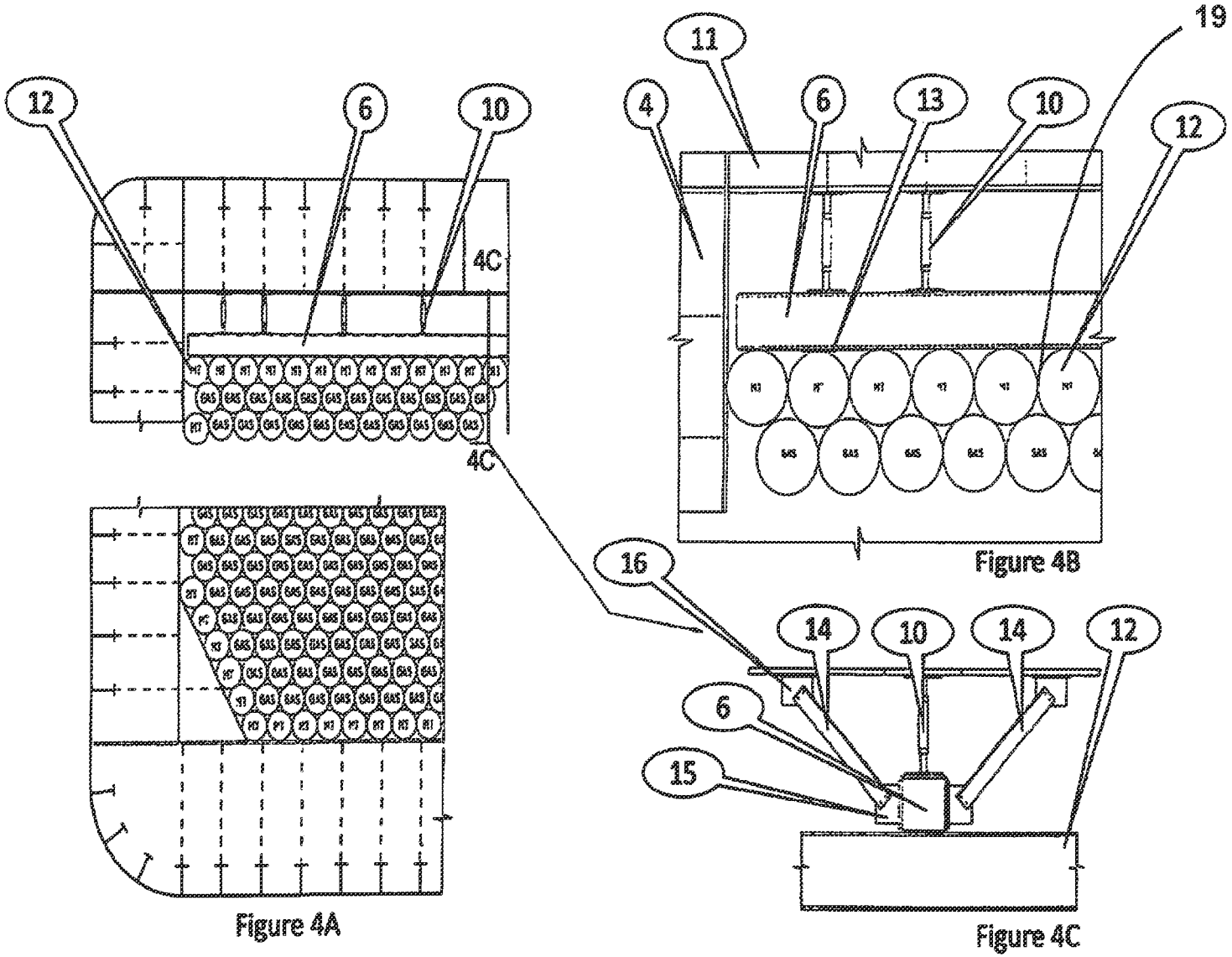
FIG. 4A is an enlarged portion of FIG. 3 showing the forcing beam 9, and the forcing mechanism, which in this case is a series of jacks 10, to create the force on the forcing beam.
FIG. 4B is an enlarged portion of FIG. 4A showing how the force from the forcing beam can be exerted on all of the pipe, even if one or more pipes are not flush with the forcing beam.
FIG. 4C is a section 4C-4C of FIG. 4A showing how the forcing beams themselves are braced to resist the substantial longitudinal forces caused by the ships motion to ensure that they do not move relative to the pipes.

Referring to FIG. 4A which is an expanded view of portions of FIG. 3. The plurality, of pipe containing gas is surrounded by a layer of pipe 12 that will always be empty. The empty pipe 12 is denoted as 'MT' and the gas filled pipe is denoted as 'GAS'. In one embodiment, the fluid containment pipes are surrounded by a plurality of empty pipes of substantially the same outer diameter as the fluid containment pipes. The purpose of the empty pipe is to distribute the loads generated by the forcing mechanism as it pushes the empty pipes against the support members. The empty pipes distribute that concentrated load into the gas containing pipes to avoid concentrated loading of the gas carrying pipes. Other means of spreading the load such as using wooden poles or other materials are also contemplated.

Referring to FIG. 4B there is one empty pipe shown to be slightly lower than the forcing beam. The gap could be caused by small differences in pipe geometry such as variances in diameter, out of roundness or other such differences. A gap would be found by visual inspection prior to applying the forcing mechanism. Shims 13 may be driven in the gap if the gap is visually obvious. If the gap is not visually obvious then the tightening of the jacks will ensure that some give will occur in one pipe and that the load will be equally shared. Also shown in FIG. 4B is the fixed top support member 11 which is preferably fixed to the side support members 4. In this embodiment the support members are integrated into the ship's hull.

Referring to FIG. 4C there is a means of bracing the forcing member 6 in the longitudinal direction to prevent any longitudinal loads pushing the forcing beam out of alignment. The bracing arms 14 provide support for the forcing beam in the longitudinal direction. The bracing arms are firmly secured after the forcing beam 6 has been fully loaded by the jacking system 10. One typical way to secure the bracing arms would be through a bolted flange 15 on the forcing beam and a similar bolted flange 16 on the top support member.

Figure 5A:
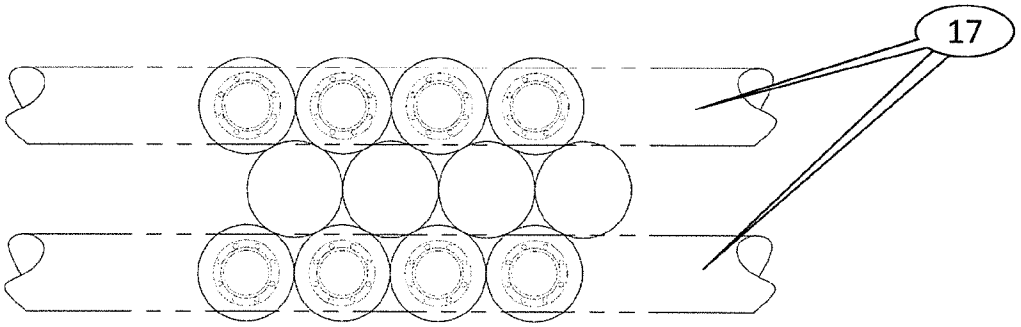
FIG. 5A is a front elevation view of a small portion of the manifold system showing two of the manifold pipes joining two rows of the plurality of pipes containing gas.
Figure 5B:
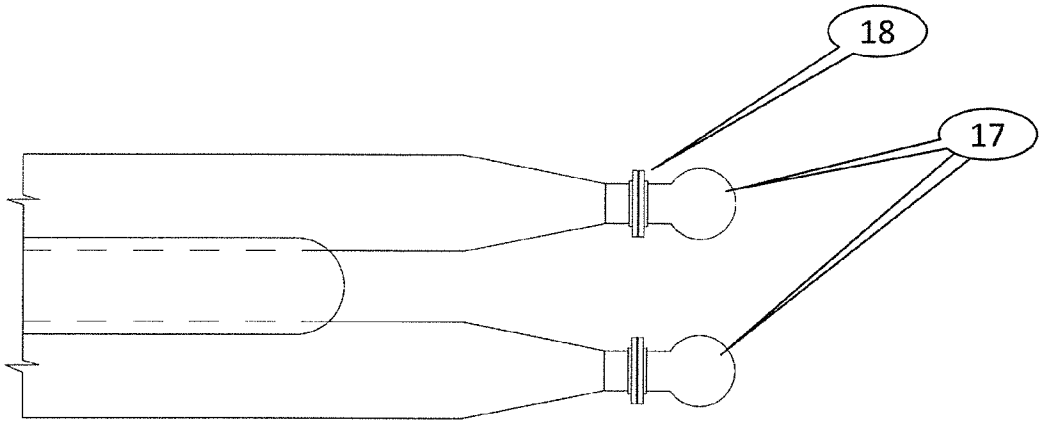
FIG. 5B is a side elevation view of a small portion of the manifold showing how the manifold is connected the gas containing pipes.

Referring to FIGS. 5A and 5B, there is a means of filling each gas containing pipe with compressed gas using a manifold system. There are many ways to provide this required manifold system and these methods are generally known. FIGS. 5A and 5B shows a preferred embodiment of a manifold system that maximizes the space for connection. Each pipe of the plurality of pipes has one tapered end and one closed end. The pipes are stacked so that each adjacent touching row has the open tapered end at alternating sides of the assemble. For example, all of the tapered open ends of the odd numbered rows would stacked so the open tapered end is forward and all of the even rows stacked so the open tapered end is aft. Each row of gas containing pipe 16 is connected to a manifold pipe 17. In this embodiment the connection is by means of a bolted flange 18. This and other joining mechanisms are well known, such as welding.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An assembly for transporting fluid comprising:

a. a barge or ship;

b. a cargo hold in said barge or ship including a lower support and a side support on each side of the lower support; and c. a plurality of pipes for fluid containment in said cargo hold, each pipe of the plurality of pipes having at least one end that is open, the plurality of pipes being supported on the lower support between the side support; and d. the plurality of pipes is stacked in a hexagonal manner; and e. an upper forcing member that is configured to forcefully bear down on the plurality of pipes to apply sufficient compressive force to the plurality of pipes stacked in the cargo hold so that friction between the pipes will prevent any significant relative movement of the pipes caused by motions of the barge or ship, or by flexing of the barge or ship, or by strains caused by differential temperature or pressure; and f. a fluid line system connected to the open ends of the plurality of pipes for filling and unloading fluid to the pipes; and wherein the upper forcing member is forced downwardly by a forcing mechanism, wherein said forcing mechanism is a plurality of jacks between the upper forcing member and a top fixed deck of the cargo hold.

2. The assembly of claim 1 where the pipes are made from steel.

3. The assembly of claim 1 further comprising:

a means for spreading stress between said upper forcing member and said plurality of pipes for fluid containment for spreading concentrated stresses generated by compression forces exerted by said upper forcing member;

wherein said means for spreading stress is a plurality of empty pipes of the same outer diameter of the fluid containment pipes wherein said plurality of empty pipes is in contact with said forcing member.

4. The assembly of claim 1 wherein said cargo hold is filled with an inert gas.

5. The assembly of claim 4 wherein:

said inert gas is nitrogen.

6. The assembly of claim 1 wherein:

the forcing mechanism includes a tightening mechanism to permit pressing the upper forcing member down over the plurality of pipes after a first force is applied to accommodate settling in the plurality of pipes.

7. The assembly of claim 1 wherein:

said lower support comprises a plurality of bottom support members incorporated in a bottom of a hull of said barge or ship.

8. The assembly of claim 1 further comprising:

a friction element between the pipes;

said friction element is a roughening of a pipe surface to maximize friction between the pipes.

9. The assembly of claim 1 further comprising:

a means for spreading stress between said upper forcing member and said plurality of pipes for fluid containment for spreading concentrated stresses generated by compression forces exerted by said upper forcing member;

said means for spreading stress is a layer of empty pipe between said upper forcing member and said plurality of fluid containing pipes, wherein said layer of empty pipes is in contact with said forcing member.

10. The assembly of claim 1 further comprising:

a means for spreading stress between said upper forcing member and said plurality of pipes for fluid containment for spreading concentrated stresses generated by compression forces exerted by said upper forcing member;

said means for spreading stress is a layer of empty pipe surrounding and encompassing said plurality of fluid containing pipes.

* * * * *